US011898273B2

(12) United States Patent
Silbermann et al.

(10) Patent No.: US 11,898,273 B2
(45) Date of Patent: Feb. 13, 2024

(54) SOLVENT-SPUN CELLULOSIC FIBER

(71) Applicant: LENZING AKTIENGESELLSCHAFT, Lenzing (AT)

(72) Inventors: Verena Silbermann, Gampern (AT); Martina Opietnik, Schörfling a. Attersee (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 832 days.

(21) Appl. No.: 16/978,253

(22) PCT Filed: Mar. 5, 2019

(86) PCT No.: PCT/EP2019/055441
§ 371 (c)(1),
(2) Date: Sep. 4, 2020

(87) PCT Pub. No.: WO2019/170670
PCT Pub. Date: Sep. 12, 2019

(65) Prior Publication Data

US 2020/0407883 A1 Dec. 31, 2020

(30) Foreign Application Priority Data

Mar. 6, 2018 (EP) ..... 18160308

(51) Int. Cl.
*D01F 2/08* (2006.01)
*D21H 13/08* (2006.01)

(52) U.S. Cl.
CPC ..... *D01F 2/08* (2013.01); *D21H 13/08* (2013.01)

(58) Field of Classification Search
CPC ..... D01F 2/08; D01F 2/00; D01F 1/10; D01F 1/02; D01F 11/02; D21C 9/001;
(Continued)

(56) References Cited

U.S. PATENT DOCUMENTS 4,246,221 A 1/1981 McCorsley, III
5,413,631 A 5/1995 Gray et al.
(Continued)

FOREIGN PATENT DOCUMENTS

BR 112016014441 B1 * 12/2021 ..... D01F 2/00
EP 1 362 935 A1 11/2003
(Continued)

OTHER PUBLICATIONS

Roder, et al., "Man-Made Cellulose Fibres—a Comparison Based on Morphology and Mechanical Properties", Lenzinger Berichte 91 (2013), pp. 7-12.
(Continued)

*Primary Examiner* — Jose A Fortuna
(74) *Attorney, Agent, or Firm* — Venable LLP

(57) ABSTRACT

The present invention relates to a cellulosic fiber of the lyocell genus. The fiber according to the invention has the following properties:

a) the fiber has a content of hemicellulose of 5 wt. % or more
b) the fiber is characterized by the Hoeller factors F1 and F2 as follows:
Hoeller factor F1≥0.7+x and ≤1.3+x
Hoeller factor F2≥0.75+(x*6) and ≤3.5+(x*6)
wherein
x is 0.5 if the fiber does not contain a matting agent and
x is 0 if the fiber does contain a matting agent, and
if x is 0.5, the fiber is essentially free from any incorporation agent.

17 Claims, 1 Drawing Sheet

(58) Field of Classification Search
CPC ..... D21H 13/02; D21H 13/08; D21H 11/16; D10B 2201/00; D01D 5/06
See application file for complete search history.

(56) References Cited

U.S. PATENT DOCUMENTS

| | | | | |
|---|---|---|---|---|
| 5,456,748 | A | 10/1995 | Quigley et al. | |
| 5,543,101 | A | 8/1996 | Ruf et al. | |
| 5,589,125 | A | 12/1996 | Zikeli et al. | |
| 5,656,224 | A | 8/1997 | Zikeli et al. | |
| 5,921,675 | A | 7/1999 | Zikeli et al. | |
| 5,968,434 | A | 10/1999 | Zikeli et al. | |
| 6,210,801 | B1 | 4/2001 | Luo et al. | |
| 6,331,354 | B1 | 12/2001 | Sealey, II et al. | |
| 6,440,547 | B1 | 8/2002 | Luo et al. | |
| 6,706,237 | B2 | 3/2004 | Luo et al. | |
| 8,500,956 | B2 | 8/2013 | Sixta et al. | |
| 8,802,229 | B2 | 8/2014 | Luo | |
| 10,883,196 | B2 * | 1/2021 | Schrempf | D01F 2/00 |
| 2009/0004473 | A1 | 1/2009 | Luo | |
| 2009/0312536 | A1 | 12/2009 | Sixta et al. | |
| 2016/0326671 | A1 * | 11/2016 | Schrempf | D01F 2/00 |
| 2020/0407883 | A1 * | 12/2020 | Silbermann | D01F 2/08 |
| 2021/0002802 | A1 * | 1/2021 | Opietnik | D04H 3/013 |
| 2021/0002825 | A1 * | 1/2021 | Silbermann | D21C 9/001 |
| 2021/0010163 | A1 * | 1/2021 | Opietnik | D21H 27/002 |
| 2022/0275537 | A1 * | 9/2022 | Schirk | D04H 1/4258 |

FOREIGN PATENT DOCUMENTS

| | | | | |
|---|---|---|---|---|
| EP | 1 311 717 | B1 | 8/2006 | |
| WO | 93/19230 | A1 | 9/1993 | |
| WO | 94/28214 | A1 | 12/1994 | |
| WO | 94/28217 | A1 | 12/1994 | |
| WO | 95/02082 | A1 | 1/1995 | |
| WO | 96/33221 | A1 | 10/1996 | |
| WO | 96/33934 | A1 | 10/1996 | |
| WO | 97/38153 | A1 | 10/1997 | |
| WO | 98/05702 | A1 | 2/1998 | |
| WO | 2007/128026 | A1 | 11/2007 | |
| WO | 2015/101543 | A1 | 7/2015 | |
| WO | WO-2021023594 | A1 * | 2/2021 | B29C 48/05 |

OTHER PUBLICATIONS

Hoeller, et al. Melliand Textilberichte, 1984, 65, pp. 573-574 (Not in English).
Wendler et al., "Polysaccharide Blend Fibres Formed from NaOH, N-Methylmorpholine-N-oxide and 1-Ethyl-3-methylimidazolium acetate", Fibers and Textiles in Eastern Europe, vol. 18, pp. 21-30 (2010).
Zhang et al., "Influence of hemicelluloses on the structure and properties of Lyocell fibers", Polymer Engineering and Science, vol. 47, pp. 702-706 (2007).
Zhang et al., "Comparison of the structures and properties of Lyocell fibers from high hemicellulose pulp and high a-cellulose pulp", Journal of Applied Polymer Science, vol. 107, pp. 636-641 (2008).
Zhang et al., "Effect of Hemicelluloses on the Structure and Properties of Lyocell Fibers", Polymer Materials Science and Engineering, vol. 24, pp. 99-102 (2008).
Zhang et al., "Preparation of Lyocell fiber from high hemicellulose pulp", China Synthetic Fiber Industry, vol. 31, pp. 24-27 (2008).
Zhang et al., "Effect of Oligosaccharide Accumulated in the Coagulation Bath on the Lyocell Fiber Process During Industrial Production", Journal of Applied Science, vol. 113, pp. 150-156 (2009).
Asaadi et al., "Structural analysis of Ioncell-F fibers from birch wood", Carbohydrate Polymers, vol. 181, pp. 893-901 (2018).
Schild et al., "Xylan Enriched Viscose Fibers", Cellulose, vol. 21, pp. 3031-3039 (2014).
Singh et al. "Study of cellulosic fibres morphological features and their modifications using hemicelluloses", Cellulose, vol. 24, pp. 3119-3130 (2017).
Höller, "New Method of Characterizing Fibres of Regenerated Cellulose," Melliand Textilberichte, vol. 65, pp. 573-574 (1984).

* cited by examiner

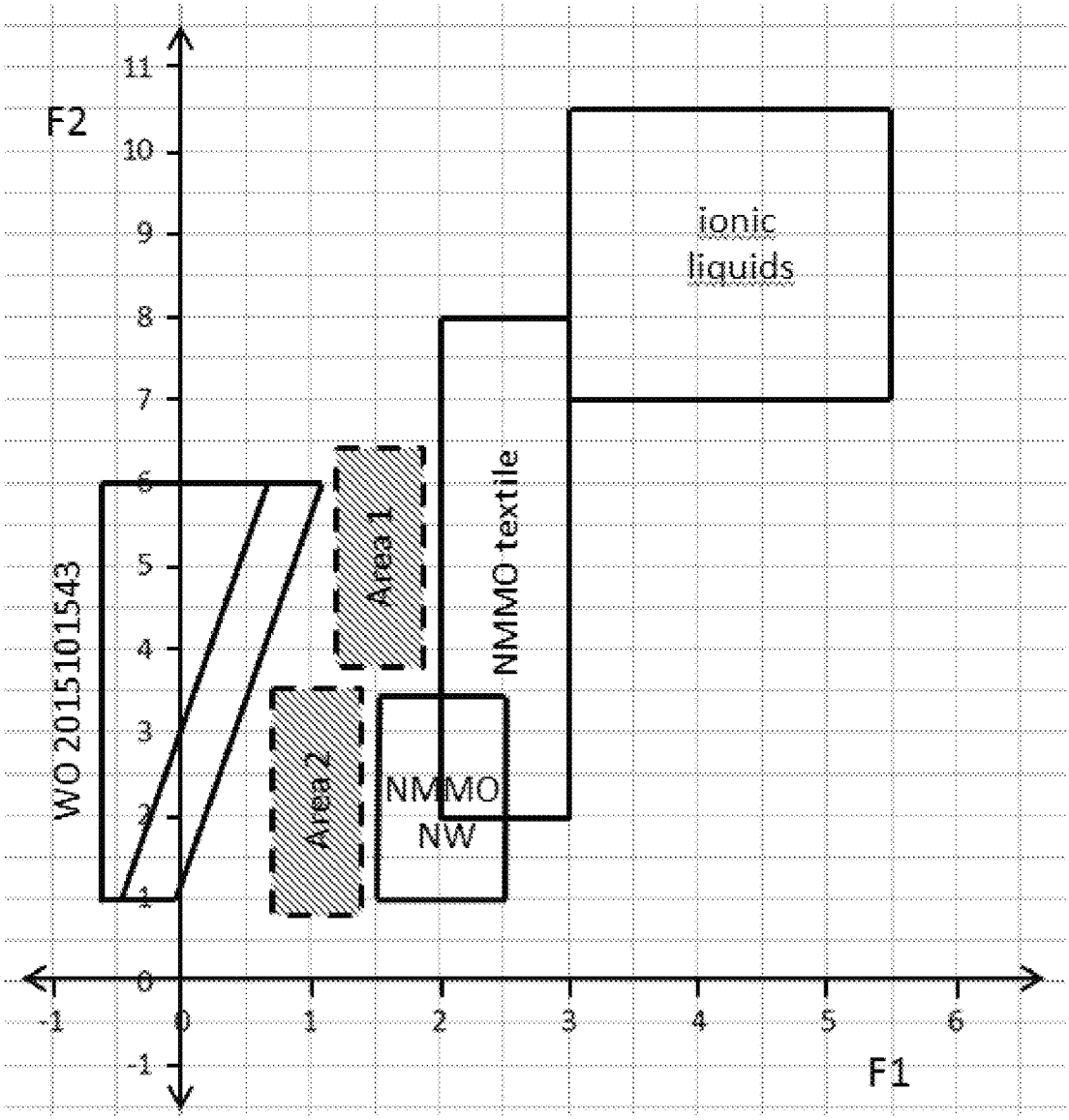
F2
F1
11
10
9
8
7
6
5
4
3
2
1
0
-1
-1
0
1
2
3
4
5
6
ionic
liquids
NMMO textile
Area 1
Area 2
NMMO
NW
WO 2015101543

SOLVENT-SPUN CELLULOSIC FIBER

The present application is a national-stage entry under 35 U.S.C. § 371 of International Patent Application No. PCT/EP2019/055441, published as WO 2019/170670 A1, filed Mar. 5, 2019, which claims priority to EP 18160308.5, filed Mar. 6, 2018, the entire disclosure of each of which is hereby incorporated by reference.

BACKGROUND OF THE INVENTION

Field of the Invention

The present invention relates to a solvent-spun cellulosic fiber of the lyocell genus.

Lyocell fibers are known in literature and by experts as fibers with excellent fiber properties (tenacity, elongation and working capacity). The term "lyocell" is a generic term as accepted by the Bureau of International Standardization of Man-Made-Fibers ("BISFA").

The structure of the lyocell fibers leads to outstanding mechanical textile properties reflected in high tenacities in dry and wet state and good dimension stabilities.

The lyocell process/lyocell technology relates to a direct dissolution process of cellulose wood pulp or other cellulose-based feedstock in a polar solvent (especially N-methylmorpholine-N-oxide [NMMO, NMO] or ionic liquids). Commercially, the technology is used to produce a family of cellulose staple fibers (commercially available from Lenzing AG, Lenzing, Austria under the trademark TENCEL® or TENCEL™) which are widely used in the textile and nonwoven industry. Other cellulose molded bodies from lyocell technology have also been produced.

According to this method, the solution of cellulose is usually extruded in a so called dry-wet-spinning process by means of a forming tool and the extruded molded solution is transferred via an air gap, in which the extruded molded solution is drawn mechanically, into a precipitation bath, where the molded body is obtained by precipitation of the cellulose. The molding is washed and optionally dried after further treatment steps. A process for production of lyocell fibers is described, for instance, in U.S. Pat. No. 4,246,221, WO 93/19230, WO95/02082 or WO97/38153. This method is also known under the term "air-gap-spinning".

The term "hemicelluloses", as employed herein, refers to materials known to the skilled person which are present in wood and other cellulosic raw material such as annual plants, i.e. the raw material from which cellulose typically is obtained. Hemicelluloses are present in wood and other plants in form of branched short chain polysaccharides built up by pentoses and/or hexoses (C5 and/or C6-sugar units). The main building blocks are mannose, xylose, glucose, rhamnose and galactose. The backbone of the polysaccharides can consist of only one unit (e.g. xylan) or of two or more units (e.g. mannan). Side chains consist of arabinose groups, acetyl groups, galactose groups and O-acetyl groups as well as 4-O-methylglucuronic acid groups. The exact hemicellulose structure varies significantly within wood species. Due to the presence of sidechains hemicelluloses show much lower crystallinity compared to cellulose. It is well known that mannan predominantly associates with cellulose and xylan with lignin. In sum, hemicelluloses influence the hydrophilicity, the accessibility and degradation behavior of the cellulose-lignin aggregate. During processing of wood and pulp, side chains are cleaved off and the degree of polymerization is decreased. The term hemicelluloses as known by the skilled person and as employed herein comprises hemicelluloses in its native state, hemicelluloses degraded by ordinary processing and hemicelluloses chemically modified by special process steps (e. g. derivatization) as well as short chain celluloses and other short chain polysaccharides with a degree of polymerization (DP) of up to 500.

Fibers are normally characterized by measuring titer, tenacity and elongation at break. Additionally, dyeability, modulus, knot tenacity, loop tenacity and fibrillation and pilling tendencies can be measured.

In 1984 Hoeller and Puchegger (*Melliand Textilberichte* 1984, 65, 573-574) introduced a "new method to characterize regenerated cellulose fibers".

The authors provided a graph which reflects the fiber properties on the basis of two calculated factors which are plotted on two axes generating the so-called "Hoeller-graph", wherein different fiber types claim different areas.

The mechanical textile fiber properties generating these two factors are well known to experts and can be found and tested according to BISFA "Testing methods viscose, modal, lyocell and acetate staple fibers and tows" Edition 2004, Chapter 7.

The two Hoeller factors are calculated as described below:

F1=−1.109+0.03992*tenacity (cond)−0.06502*elongation (cond)+0.04634*tenacity (wet)−0.04048*elongation (wet)+0.08936*BISFA-Modulus+0.02748*loop tenacity+0.02559*knot tenacity F2=−7,070+0.02771*tenacity (cond)+0.04335*elongation (cond)+0.02541*tenacity (wet)+0.03885*elongation (wet)−0.01542 BISFA-Modulus+0.2891 loop tenacity+0.1640 knot tenacity According to *Lenzinger Berichte* 2013, 91, 07-12, in the Hoeller graph, fibers from different production processes, e.g. direct dissolution vs derivatization, can be clearly distinguished from each other. Also, among the direct dissolution fiber types, fibers produced from different direct solvents claim different areas—e.g. fibers spun from solutions in ionic liquids or, on the other hand, NMMO.

Commercial lyocell fibers exhibit Hoeller-F1-values between 2 and 3 and Hoeller-F2-values between 2 and 8 (WO 2015/101543 and *Lenzinger Berichte* 2013, 91, 07-12). Fibers recovered from direct dissolutions in ionic liquids cover an area from Hoeller-F1-values between 3 and 5.5 and Hoeller-F2-values between 7 and 10.5 (*Lenzinger Berichte* 2013, 91, 07-12). WO 2015/101543 discloses a new lyocell fiber type with Hoeller-F2-values in a lower region between 1 and 6 and Hoeller-F1-values between −0.6 and a right upper boarder which is defined by F2−4.5*F1≥3, specifically ≥1.

Thus, WO 2015/101543 describes a lyocell fiber with a specific location within the Hoeller diagram. The lyocell fibers claimed were produced using mixtures of high quality wood pulps with high α-content and low non-cellulose contents such as hemicelluloses to reach a specific molecular weight distribution and optimized spinning parameters. The air gap influence is reduced, spinning is performed at high temperatures and by employing lower drawing ratios.

In the literature up to now, only textile fibers were examined using the Hoeller graph.

Nonwoven fiber types contain matting agents like $TiO_2$ giving the fiber a dull appearance compared to the bright textile fibers.

EP 1 362 935 describes the preparation of a hemi-rich pulp and the production of lyocell fibers thereof. In the examples, the meltblown technology is described. The fibers produced by the meltblown technology are analyzed by crystallinity and tenacity. To achieve staple fibers, the fiber bundles are opened by hand. This method does not reflect to the process described in this invention.

The lyocell fiber production method described in the present invention is not comparable to the meltblown technology. The principle of the fiber forming method is described above.

U.S. Pat. No. 6,440,547 describes the preparation of a hemi-rich pulp and the production of lyocell fibers in a similar way to EP 1 362 935. In this patent not only the meltblown technology is used for the production of fibers, but also an air-gap technology for the production of lyocell staple fibers.

Additionally, EP 1 311 717 also describes the production of hemi-rich lyocell fibers using the air gap technology, analyzing the fibers more properly measuring besides tenacity wet/dry and elongation also loop tenacity, initial modulus and wet modulus. The fibers mentioned in these patents show excellent fiber properties (tenacity, elongation), suggesting that these fibers will fall into the area of standard lyocell fibers.

Wendler et al (*Fibers and textiles in Eastern Europe* 2010, 18, 2 (79), 21-30) describe the addition of different polysaccharides (xylans, mannans, xylan derivative,) into, inter alia, lyocell dopes (NMMO, ionic liquids, spinning of these dopes on a bench-scale laboratory unit (producing 1.5 kg fibers) and subsequent analysis of the fibers. Only an insignificant decrease in the fiber properties (tenacity and elongation) with the addition of xylans in NMMO-based dopes was observed. It is suspected that fibers act differently, if they are produced a) by addition of polysaccharides into the dope or b) direct dissolution of a hemi-rich pulp. The fibers are produced on a bench-scale laboratory unit, which does not reflect to commercial production.

Schild et al (Cellulose 2014, 21, 3031-3039) describe xylan-enriched viscose fibers, wherein the xylan is added in a late step in the viscose production process. The authors detected a decrease in the fiber properties. Singh et al (Cellulose, 2017, 24, 3119-3130) also add hemicelluloses to the viscose process. They postulate that the fiber properties stay unaffected by this addition. Lyocell fibers are mentioned as reference fibers, but no addition of xylan is described. The viscose technology includes a chemical reaction step wherein the cellulose is structurally changed to a derivative, which is subsequently cleaved off in the spinning bath to form cellulose again. This technology cannot be compared to the direct dissolution lyocell technology.

Zhang et al (*Polymer Engineering and Science* 2007, 47, 702-706) describe lyocell fibers with higher hemicellulose contents. They postulate that the tensile strength only decreases insignificantly and that the fiber properties could be increased by higher pulp concentrations in the spinning dope.

Zhang et al (*Journal of Applied Polymer Science,* 2008, 107, 636-641), Zhang et al (*Polymer Materials Science and Engineering* 2008, 24, 11, 99-102) disclose the same figures as the paper by Zhang et al (*Polymer Engineering and Science* 2007, 47, 702-706.

Zhang et al (*China Synthetic Fiber Industry,* 2008, 31, 2, 24-27) describe better mechanical properties for coarse lyocell fibers (2,3 dtex) with higher hemi-contents. The same authors postulate this same theory in *Journal of Applied Science* 2009, 113, 150-156.

It is an object of the present invention to provide a lyocell fiber, which approximates viscose fibers in properties like enhanced water retention value. The invented fibers could replace viscose fibers in some applications with lyocell fibers produced by an environmental-friendly, closed-loop process.

This object is solved by a cellulosic fiber of the lyocell genus, characterized by the following properties:

a) the fiber has a content of hemicellulose of 5 wt. % to 50 wt. % b) the fiber is characterized by the Hoeller factors F1 and F2 as follows:

Hoeller factor F1≥0.7+x and ≤1.3+x

Hoeller factor F2≥0.75+(x*6) and ≤3.5+(x*6)

wherein x is 0.5 if the fiber does not contain a matting agent, x is 0 if the fiber does contain a matting agent and if x is 0.5, the fiber is essentially free from any incorporation agent.

Preferred embodiments are disclosed in the dependent claims.

SHORT DESCRIPTION OF THE DRAWINGS

FIG. 1 shows a Hoeller Graph, illustrating the location of the lyocell fibers of the present invention in said Graph as compared to other lyocell fiber types.

DETAILED DESCRIPTION OF THE INVENTION

Surprisingly, the object of the present invention was solved by lyocell fibers exhibiting a certain range of Hoeller factors as per claim 1.

FIG. 1 shows the location of the novel lyocell fibers in the Hoeller Graph.

The first area claimed is defined by a Hoeller factor F1 between 1.2 and 1.8 and a Hoeller factor F2 between 3.75 and 6.5. The fibers according to the invention within this area are lyocell fibers for textile applications with titers of 1 dtex up to 6.7 dtex, especially 1.3 dtex up to 6.7 dtex, preferably 3.3 dtex or less, preferably 2.2 dtex or less, even more preferably 1.7 dtex or less. Especially preferred titer ranges are from 1 dtex to 3.3 dtex, more preferred 1.3 dtex to 2.2 dtex. Also preferred is a titer range of from 1.7 dtex to 2.2 dtex.

The second area claimed is defined by a Hoeller factor F1 between 0.7 and 1.3 and a Hoeller factor F2 between 0.75 and 3.5. The fibers within this area are lyocell fibers for non-woven applications with a standard titer of from 1.3 dtex to 2.2 dtex, especially 1.3 dtex to 1.7 dtex, but also 1.7 dtex to 2.2. dtex, and containing a matting agent (e.g. $TiO_2$).

It can be seen that for both alternatives the regions in the Hoeller Graph distinguish the fibers according to the present invention from a) Standard lyocell fibers (textile and nonwoven applications) made from a cellulose solution in NMMO b) lyocell fibers made from solutions in ionic liquids c) lyocell fibers according to WO 2015/101543

Furthermore, the two fiber alternatives (fibers for textile and nonwovens applications) are differentiated from each other in the two areas described above.

In case the fiber according contains no matting agent (X=0.5), the fiber is also essentially free from any incorporation agent. The term "essentially free from any incorporation agent" means that apart from any impurities that may be contained in the spinning dope used for spinning the fiber, no incorporation agent has been added to the spinning dope. The term "incorporation agent" means an agent which, under the conditions of the respective process used for spinning the fiber, especially under the conditions of the amine-oxide process, remains distributed within the cellulose matrix of the fiber after the cellulose has been precipitated from the spinning solution.

The term "essentially free" especially means a content of incorporation agents of less than 0.05 wt. % based on cellulose.

In case the fiber according to the present invention contains a matting agent, the matting agent is contained in the fiber in a range of from 0.1 wt. % to 10 wt. %, preferably 0.3 wt. % to 5 wt. %, most preferably 0.5 wt. % to 1 wt. %.

The matting agent may be selected from the group consisting of $TiO_2$, $CaCO_3$, ZnO, kaolin, talc, fumed silica, $BaSO_4$, and mixtures thereof.

In a further preferred embodiment, the fiber according to the present invention exhibits a water retention value (WRV) of from 70% and higher, preferably 75% to 85%.

This is a higher WRV than that of standard lyocell fibers and comes closer to the absorption capacities of viscose fibers.

A preferred fiber according to the present invention is characterized by a content of hemicellulose of from 7 wt. % to 50 wt. %, preferably 7 wt. % to 25 wt. %

Preferably, the fiber according to the present invention has been obtained by an amine-oxide process, i.e. from a solution of cellulose in an aqueous tertiary amine oxide, such as N-methylmorpholine-N-oxide.

Standard lyocell fibers are currently produced from high quality wood pulps with high α-content and low non-cellulose contents such as hemicelluloses.

In contrast thereto, the lyocell fibers described are produced from hemi-rich pulps (≥7% wt hemicellulose content).

In two exemplary embodiments of the present invention, two different Kraft pulps from different wood sources were chosen to produce these fibers.

The fibers were produced on a semi-commercial pilot plant (~1 kt/a) with sufficient drawing ratios, production velocities and a complete, commercial-like after-treatment of the fiber. A straightforward scale-up from this production unit to a commercial unit (>30 kt/a) is feasible and reliable.

U.S. Pat. Nos. 6,440,547, 6,706,237, EP 1 362 935 and EP 1 311 717 describe the preparation of a hemi-rich pulp and the production of lyocell fibers using an air-gap technology for the production of staple fibers. According to the information provided in these documents regarding the experiments as well as the excellent fiber properties (tenacity, elongation) of the fibers produced with this technology, the skilled artisan can conclude that the fibers were produced on a bench-scale laboratory unit, without a complete after-treatment. Such a complete aftertreatment would, e.g., include continuous washing steps performed on the fiber bundle with varying temperatures and pH-value, allowing the fiber bundle to be washed to equilibrium state and, thus, have an impact on the tensile fiber properties.

It is well known to experts that high tenacity and elongation values extrapolate also to the other measured values included in the Hoeller factors (e.g. loop strength and elongation). Thus, if the tenacity and elongation of a fiber are excellent, the loop strength and elongation are expected to be excellent as well.

Therefore, the fibers produced according to the above cited documents at this bench-scale unit, which does not reflect the commercial production, will be located in the area of state-of-the-art commercial lyocell fibers.

For a commercial production, production capacities of at least 1 ton fibers per year (semi-commercial production), especially at least 1,000 tons up to 30,000 tons of fibers per year and more are required.

Accordingly, the present invention also provides a fiber bundle containing a plurality of fibers according to any of the preceding claims. A "fiber bundle" is understood to be a plurality of fibers, for example, a plurality of staple fibers, a strand of continuous filaments or a bale of fibers, which may contain up to several hundred kilograms of fiber.

Especially, the fiber bundle according to the present invention may contain at least 20 kg, preferably at least 70 kg of the fiber according to the invention, preferably in the form of a fiber bale.

WO 2007/128026 discloses production of a lyocell fiber from certain pulps. One of the pulps used for producing lyocell fiber is disclosed in this document to have a relatively high content of hemicellulose (7.8 wt. % of xylan and 5.3 wt. % of mannan). The viscosity of this pulp is disclosed to be 451 ml/g.

For the manufacture of the fiber of the present invention, the pulp employed should have a viscosity of 300-440 ml/g, especially 320-420 ml/g.

Thus, in one preferred embodiment of the present invention the pulp employed for the preparation of the lyocell fibers, as described herein, has a scan viscosity in the range of from 300-440 ml/g, especially 320-420 ml/g, more preferably 320 to 400 ml/g.

The scan viscosity is determined in accordance with SCAN-CM 15:99 in a cupriethylenediamine solution, a methodology which is known to the skilled person and which can be carried out on commercially available devices, such as the device Auto PulpIVA PSLRheotek available from psl-rheotek. The scan viscosity is an important parameter influencing in particular processing of the pulp to prepare spinning solutions. Even if two pulps seem to be of great similarity as raw material for the lyocell-process, different scan viscosities will lead to completely different behavior different during processing. In a direct solvent spun process like the lyocell-process the pulp is dissolved in NMMO as such. No ripening step exists comparable to the viscose process where the degree of polymerization of the cellulose is adjusted to the needs of the process. Therefore, the specifications for the viscosity of the raw material pulp typically are within a small range. Otherwise, problems during production may arise. In accordance with the present invention it has been found to be advantageous if the pulp viscosity is as defined above. Lower viscosities compromise mechanical properties of the lyocell products. Higher viscosities in particular may lead to the viscosity of the spinning dope being higher and therefore, spinning will be slower. With a slower spinning velocity lower draw ratios will be attained, which significantly alters the fiber structure and its properties (Carbohydrate Polymers 2018, 181, 893-901; Structural analysis of Ioncell-F fibers from birch wood, Shirin Asaadia; Michael Hummel; Patrik Ahvenainen; Marta Gubitosic; Ulf Olsson, Herbert Sixta). This will require process adaptations and will lead to a decrease in mill capacity. Employing pulps with the viscosities as defined here enables smooth processing and production of high quality products.

The pulps employed in the present invention, as outlined herein, show a high content of hemicelluloses. Compared with the standard low hemicellulose content pulp employed for the preparation of standard lyocell fibers, the pulps employed in accordance with the present invention also show other differences: Compared with standard pulps the pulps as employed herein display a more fluffy appearance, which after milling (during preparation of starting materials for the formation of spinning solutions for the lyocell process), results in the presence of a high proportion of larger particles. As a result, the bulk density is much lower, compared with standard pulps having a low hemicellulose content. In addition, the pulps employed in accordance with the present invention are more difficult to impregnate with NMMO. All these different properties require certain adaptations during spinning solution preparation, such as increased dissolution time (e.g. explained in WO 94/28214 and WO 96/33934) and/or increased shearing during dissolution (e.g. WO 96/33221, WO 98/05702 and WO 94/28217). This ensures the preparation of a spinning solution enabling the use of the pulps described herein in standard lyocell spinning processes.

EXAMPLES

Example 1

Lyocell Fiber Production From Different Pulps

The pulps specified in table 1 were converted to spinning dopes and processed to lyocell fibers, according to WO 93/19230, with titers differing between 1.3 to 2.2 dtex.

Fiber 1 was produced continuously, using hemi-rich pulp 1, in semi-commercial scale (1 kt/a), including a complete aftertreatment of the fibers. Fiber 2 was produced using hemi-rich pulp 2 in a discontinuous production unit. Furthermore, both fiber 1 and fiber 2 were produced in a bright/textile version and in a dull/nonwoven version with the addition of a matting agent ($TiO_2$).

Lyocell standard fibers (CLY std.) are produced from standard lyocell pulp with (NW, dull) or without (TX, bright) matting agent.

TABLE 1

Hemi composition of different pulps:

| | standard lyocell pulp | hemi-rich pulp 1 | hemi-rich pulp 2 |
|---|---|---|---|
| Sugar content-xylan [%] | 1.2 | 8.3 | 14 |
| Sugar content-mannan [%] | 1.1 | 5.7 | <0.2 |
| Viscosity [ml/g] | 406 and 415, resp. | 372 | 383 |

The tensile properties of the fibers thus produced as well we as the resulting Hoeller Factors 1 and 2 are assembled in the following Table 2

TABLE 2

Fiber properties of the different fibers

| Fiber type/titre/cutting length (mm)/dull or bright | Titer dtex | FFk. cN/tex | FDk. % | Modul kond. cN/tex/% | FFn. cN/tex | FDn. % | Bisfa Modul cN/tex/5% | SFk. cN/tex | SDk. % | KFk. cN/tex | Hoeller factor F1 | Hoeller factor F2 |
|---|---|---|---|---|---|---|---|---|---|---|---|---|
| fiber1 1.7/38/dull | 1.75 | 28.1 | 11.5 | 5.0 | 24.5 | 17.8 | 7.0 | 11.5 | 4.0 | 22.3 | 1.2 | 2.6 |
| fiber1 1.7/38/dull | 1.71 | 28.9 | 12.8 | 4.1 | 24.6 | 18.6 | 6.6 | 12.1 | 4.3 | 21.0 | 1.1 | 2.7 |
| fiber1 1.7/38/dull | 1.70 | 25.6 | 10.6 | 3.5 | 23.6 | 16.7 | 7.2 | 11.5 | 3.6 | 24.2 | 1.2 | 2.8 |
| fiber2 1.7/38/dull | 1.72 | 27.6 | 11.4 | 5.2 | 23.4 | 17.2 | 6.8 | 11.1 | 3.9 | 21.7 | 1.1 | 2.3 |
| CLY NW* std. 1.7/38/dull | 1.79 | 32.1 | 12.7 | 3.9 | 28.2 | 18.4 | 7.3 | 11.5 | 3.7 | 23.8 | 1.5 | 3.1 |
| CLY NW std. 1.7/38/dull | 1.75 | 30.6 | 12.6 | 4.8 | 26.1 | 15.9 | 8.6 | 11.8 | 3.1 | 20.6 | 1.5 | 2.5 |
| fiber1 1.3/38/bright | 1.32 | 30.9 | 12.1 | 4.6 | 26.8 | 18.5 | 7.6 | 17.9 | 6.5 | 27.1 | 1.7 | 5.4 |
| fiber1 1.3/38/bright | 1.36 | 31.1 | 13.8 | 4.0 | 25.6 | 17.8 | 7.2 | 19.3 | 7.1 | 25.8 | 1.5 | 5.7 |
| fiber1 1.3/38/bright | 1.31 | 31.1 | 13.7 | 4.4 | 26.4 | 18.7 | 7.3 | 18.2 | 5.8 | 27.4 | 1.6 | 5.7 |
| fiber1 2.2/38/bright | 2.12 | 28.2 | 12.1 | 3.6 | 24.1 | 18.3 | 6.9 | 15.1 | 5.6 | 23.9 | 1.2 | 4.0 |
| fiber1 2.2/38/bright | 2.24 | 28.1 | 12.0 | 3.9 | 21.6 | 15.8 | 6.9 | 15.3 | 5.3 | 23.5 | 1.2 | 3.8 |
| CLY TX** std. 1.3/38/bright | 1.32 | 36.1 | 13.5 | 6.4 | 30.7 | 18.3 | 8.5 | 17.0 | 4.7 | 28.7 | 2.1 | 5.8 |
| CLY TX std. 1.3/38/bright | 1.23 | 35.3 | 14.0 | 5,. | 30.3 | 17.6 | 8.3 | 17.6 | 4.9 | 28.4 | 2.0 | 5.8 |
| CLY TX 1.7/38/bright | 1.65 | 38.6 | 14.8 | 5.4 | 31.5 | 17.4 | 8.5 | 19.5 | 5.8 | 29.3 | 2.3 | 6.7 |
| CLY TX std. 2.2/38/bright | 2.14 | 41.7 | 13.4 | 7.2 | 33.1 | 16.9 | 9.5 | 19.1 | 4.9 | 32.4 | 2.7 | 7.1 |

*NW: Nonwoven

**TX: Textile

It can be seen from table 2 that the fibers according to the present invention, i.e. "fiber 1" and "fiber 2" exhibit Hoeller Factors F1 and F2 which locate them into the specific field as defined above and distinguish them from standard lyocell fibers.

In the following table 3, the water retention values (WRV) measured according to DIN 53814 (1974) as described below of the fibers of the present invention are compared with those of standard lyocell fibers as well as viscose fibers.

For determining the water retention value, a defined quantity of dry fibers is introduced into special centrifuge tubes according to DIN 53814 (with an outlet for the water). The fibers are allowed to swell in deionized water for 5 minutes. Then they are centrifuged at 3000 rpm for 15 minutes, whereupon the moist cellulose is weighed right away. The moist cellulose is dried for 4 hours at 105° C., whereupon the dry weight is determined. The WRV is calculated using the following formula:

$$WRV[\%] = \frac{(mf - mt)}{mt * 100} \quad (m_f = \text{moist mass}, m_t = \text{dry mass})$$

The water retention value (WRV) is a measured value that indicates how much water of a moisture penetrated sample is retained after centrifuging. The water retention value is expressed as a percentage relative to the dry weight of the sample.

In table 3 the water retention values of the fibers of the present invention (fiber 1 and 2) compared to the reference fibers are listed and an increase of the WRV by 19% and 26% respectively compared to standard CLY fibers can be observed.

TABLE 3

Water retention values of different fibers

| Fiber type | WRV [%] |
|---|---|
| CLY std. 1.3 dtex/38 mm bright | 69.6 |
| viscose std 1.3 dtex/40 mm bright | 89.9 |
| fiber 11.3 dtex/38 mm bright | 82.8 |
| CLY standard 1.7 dtex/38 mm dull | 65.3 |
| fiber 1 1.7 dtex/38 mm dull | 82.1 |
| fiber 2 1.7 dtex/38 mm dull | 78.0 |

It can clearly be seen that the fibers according to the present invention ("fiber 1" and "fiber 2") exceed standard lyocell fibers in terms of water their WRV and, thus, render them more similar to viscose fibers.

The invention claimed is:

1. A cellulosic fiber of the lyocell genus, wherein the fiber has a content of hemicellulose of 5 wt. % to 50 wt. % and the fiber is characterized by Hoeller factors F1 and F2 as follows:

Hoeller factor F1≥0.7+x and ≤1.3+x

Hoeller factor F2≥0.75+(x*6) and ≤3.5+(x*6)

wherein x is 0.5 if the fiber does not contain a matting agent, x is 0 if the fiber does contain a matting agent, and if x is 0.5, the fiber is essentially free from any incorporation agent.

2. The fiber according to claim 1, wherein x is 0.5 and wherein

Hoeller factor F1≥1.2 and ≤1.8

Hoeller factor F2≥3.75 and ≤6.5.

3. The fiber according to claim 1, wherein x is 0 and wherein

Hoeller factor F1≥0.7 and ≤1.3 and

Hoeller factor F2≥0.75 and ≤3.5.

4. The fiber according to claim 3, comprising from 0.1 wt. % to 10 wt. % of the matting agent.

5. The fiber according to claim 4, comprising from 0.3 wt. % to 5 wt. % of the matting agent.

6. The fiber according to claim 5, comprising from 0.5 wt. % to 1 wt. % of the matting agent.

7. The fiber according to claim 3, wherein the matting agent is selected from the group consisting of $TiO_2$, $CaCO_3$, ZnO, kaolin, talc, fumed silica, $BaSO_4$, and mixtures thereof.

8. The fiber according to claim 1, having a water retention value (WRV) of from 70% and higher.

9. The fiber according to claim 8, wherein the water retention value (WRV) is from 75% to 85%.

10. The fiber according to claim 1, wherein the content of hemicellulose is from 7 wt. % to 50 wt. %.

11. The fiber according to claim 1, wherein the fiber is obtained by an amine-oxide process.

12. A fiber bundle comprising a plurality of fibers according to claim 1.

13. The fiber bundle according to claim 12, comprising at least 20 kg of the fibers.

14. The fiber bundle according to claim 13, comprising at least 70 kg of the fibers.

15. The fiber bundle according to claim 14, wherein the fiber is in the form of a fiber bale.

16. The fiber bundle according to claims 13, wherein the fiber is in the form of a fiber bale.

17. The fiber according to claim 1, wherein the content of hemicellulose is from 7 wt. % to 25 wt. %.

* * * * *